US007402232B2

(12) United States Patent
Ogihara et al.

(10) Patent No.: US 7,402,232 B2
(45) Date of Patent: Jul. 22, 2008

(54) SILVER ELECTROPLATING SOLUTION

(75) Inventors: Yoko Ogihara, Nagano (JP); Shinichi Wakabayashi, Nagano (JP); Masao Nakazawa, Nagano (JP)

(73) Assignee: Shinko Electric Industries, Co., Ltd., Nagano (JP)

( * ) Notice: Subject to any disclaimer, the term of this patent is extended or adjusted under 35 U.S.C. 154(b) by 99 days.

(21) Appl. No.: 10/512,632

(22) PCT Filed: Oct. 30, 2003

(86) PCT No.: PCT/JP03/13955

§ 371 (c)(1),
(2), (4) Date: Oct. 26, 2004

(87) PCT Pub. No.: WO2004/048646

PCT Pub. Date: Jun. 10, 2004

(65) Prior Publication Data

US 2006/0060474 A1 Mar. 23, 2006

(30) Foreign Application Priority Data

Nov. 28, 2002 (JP) ..... 2002-345783

(51) Int. Cl.
*C25D 3/46* (2006.01)
*B22F 7/00* (2006.01)

(52) U.S. Cl. ..... 205/263; 106/1.26

(58) Field of Classification Search ..... 106/1.26; 205/263

See application file for complete search history.

(56) References Cited

U.S. PATENT DOCUMENTS

| | | | | |
|---|---|---|---|---|
| 4,265,715 A | | 5/1981 | Rosegren et al. | 204/46 R |
| 4,310,392 A | * | 1/1982 | Kohl | 205/297 |
| 4,604,167 A | * | 8/1986 | Wakabayashi et al. | 205/205 |
| 4,614,568 A | | 9/1986 | Okubo et al. | 204/29 |

FOREIGN PATENT DOCUMENTS

| | | | |
|---|---|---|---|
| DE | 1098781 | * | 2/1961 |
| JP | A-56-13491 | | 2/1981 |
| JP | 57-43995 | | 3/1982 |
| JP | 2756300 | | 3/1998 |
| JP | 11302893 A | * | 11/1999 |

OTHER PUBLICATIONS

International Searching Authority; Japanese Patent Office; "PCT International Search Report"; corresponding to International Application No. PCT/JP03/13955; date of mailing Dec. 9, 2003; (second sheet).

* cited by examiner

*Primary Examiner*—Edna Wong
(74) *Attorney, Agent, or Firm*—Chadbourne & Parke LLP; Walter G. Hanchuk

(57) ABSTRACT

A silver electroplating solution containing a cyanide as a silver source, said silver electroplating solution characterized by containing at least one type of compound of As, Tl, Se, and Te as a brightener and a brightness adjuster having a benzothiazole skeleton or benzoxazole skeleton. This plating solution utilizes the high speed property of gloss agents to the maximum, does not have an effect on the current density, gives stable non- or semi-gloss plating appearance, and facilitates control.

14 Claims, No Drawings

SILVER ELECTROPLATING SOLUTION

TECHNICAL FIELD

The present invention relates to a silver electroplating solution, more particularly relates-to a high speed non-gloss or high speed semi-gloss silver electroplating solution using a cyanide as a silver source.

BACKGROUND ART

In the past, for silver electroplating solutions, silver electroplating solutions using a cyanide as a silver source and including compounds of As, Tl, Se, and Te as brighteners have been known (Japanese Patent No. 2756300).

By adding these gloss agents, there are the advantages that glossy silver plating films are obtained even with slight amounts of addition, the brightness degree increases the greater the amount of addition, the working current density is raised, and the speed is increased.

On the other hand, when forming silver plating films at front ends of inner leads or die pads etc. of lead frames for semiconductor packages, if bright (meaning becoming close to mirror surfaces), conversely problems such as image recognition not being possible at the time of wire bonding and sealability becoming inferior arise. Consequently, plating aiming at matt or semi-bright has been performed. Therefore, it has been necessary to lower the amounts of addition of brighteners.

In the case of the above gloss agents, however, originally only very small amounts were added, so if further lowering the amounts of addition, analysis becomes difficult and routine control of the amounts of addition by analysis becomes impossible. In practice, the amounts of addition are judged by the experience and judgment of the workers. Good control over the amounts of addition is therefore difficult.

Further, if reducing the amounts of addition of gloss agents, the working current density becomes low and the range becomes narrower, the production efficiency drops, and plating defects easily occur. In this case, if raising the working current density to raise the production efficiency, so-called "burnt deposits" or uneven plating ends up occurring.

DISCLOSURE OF INVENTION

An object of the present invention is to provide a silver electroplating solution using a cyanide as a silver source which utilizes the high speed property of brighteners to the maximum, does not have an effect on the current density, gives a stable matt or semi-bright plating appearance, and facilitates control.

The silver electroplating solution using a cyanide as a silver source of the present invention is characterized by containing at least one type of compound of As, Tl, Se, and Te as a brightener and a brightness adjuster having a benzothiazole skeleton or benzoxazole skeleton.

The solution should contain as a metal salt 50 to 300 g/liter of a silver-like alkali metal cyanide and as a conductive salt 50 to 300 g/liter of at least one of a citrate, phosphate, tartarate, and succinate. These conductive salts function also as pH buffers. Further, as a buffer, it is also possible to add boric acid or a borate.

Further, in accordance with need, it is also possible to add a surfactant. As such a surfactant, a nonionic surfactant having a polyoxyethylene chain or a fluorine-based surfactant is suitable. These surfactants should be added in amounts of 0.001 to 10 g/liter or so.

As the brighteners, in the same way as the past, compounds of As, Tl, Se, and Te are used.

As these brighteners, potassium arsenite, sodium arsenite, potassium sulfate, thallium formate, selenium dioxide, potassium selenocyanate, telluric acid, tellurium dioxide, etc. are suitable.

By using these compounds for gloss agents, the brightness degree may be adjusted, but control of fine amounts in the matt to semi-bright range is not easy as explained above.

In the present invention, by adding the later mentioned brightness adjuster to the plating solution, the brightness degree can be kept down. Therefore, the amount of brightener can be managed by an analysis system (for example, ICP analysis or atomic absorption analysis). Further, the amount of brightener can be increased. Therefore, the working current density can be raised. The range becomes broader and therefore the production efficiency can be improved and the work efficiency can be improved.

The amount of addition of the brightener is suitably in the range of 0.005 to 50 mg/liter, optimally the range of 0.01 to 5 mg/liter. This range of amount of addition is the normal range of a bright electroplating (bright silver plating) solution.

The amount of addition of the gloss adjuster is suitably in the range of 1 to 1000 mg/liter, optimally the range of 10 to 100 mg/liter. If the amount of addition of the brightness adjuster is less than 1 mg/liter, there is little brightness adjustment effect and the working current density also will not be able to be raised. Even if more than 1000 mg/liter, the effect will not change that much compared with the amount of addition.

Further, the amount of addition of the brightness adjuster is suitably changed in accordance with the amount of the brightener.

For example, when the amount of addition of the brightener is about 0.05 to 0.1 mg/liter, the amount of the brightness adjuster is suitably made around 10 mg/liter, while when the amount of addition of the brightener is about 0.5 mg/liter, the amount of the brightness adjuster is suitably made around 30 mg/liter.

As the compound having a benzothiazole skeleton of the brightness adjuster, the following compounds are suitable:

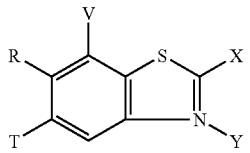

R: H, $CH_3$, $CH_3O$
T: H
V: H, $SO_3Na$
Y: H, $CH_3$
X: one of the following a to i
a.
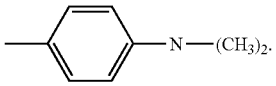
b.
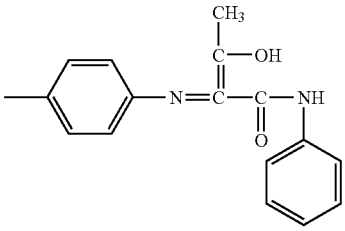
c.
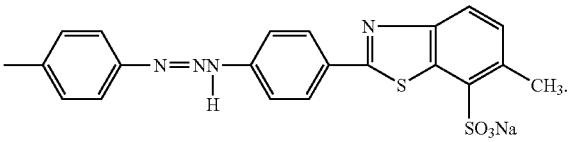
d.
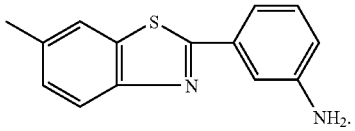
e.
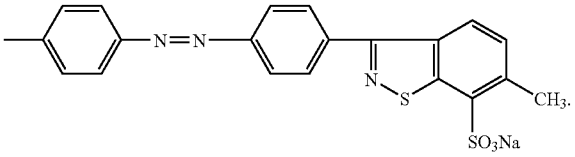
f.
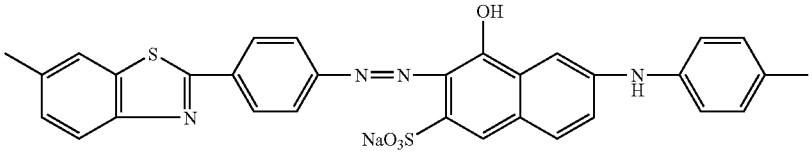
e.
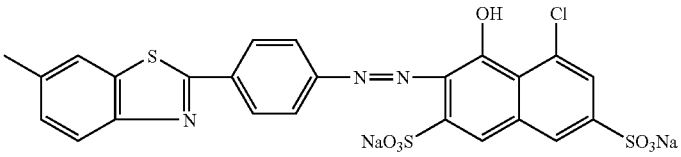
h.
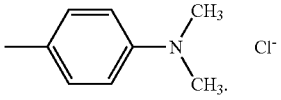
$Cl^-$:counter ion
i.
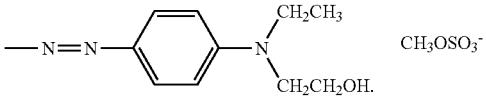
$CH_3OSO_3^-$ :counter ion That is, in the above, R is H, $CH_3$, or $CH_3O$, T is H, V is H or $SO_3Na$, Y is H or $CH_3$, and X is any of a to i. Further, as the compound having a benzoxazole skeleton of the gloss adjuster, the following compound is suitable:

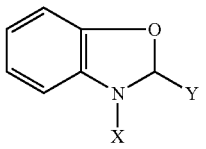

X: —$CH_2CH_2CH_2SO_3Na$
Y: one of the following a to b a.

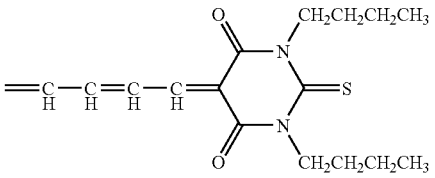

-continued b.

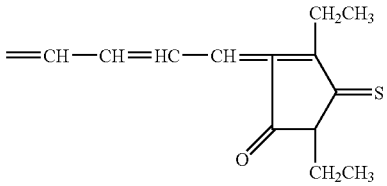

That is, in the above, X is —$CH_2CH_2CH_2SO_3Na$ and Y is any of the above a or b.

BEST MODE FOR CARRYING OUT THE INVENTION

The compositions of plating solutions of Examples 1 to 5 and Comparative Examples 1 to 2 are shown in Table 1.

TABLE 1

| | Ex. 1 | Ex. 2 | Ex. 3 | Ex. 4 | Ex. 5 | Comp. Ex. 1 | Comp. Ex. 2 |
|---|---|---|---|---|---|---|---|
| $KAg(CN)_2$ | 80 | 80 | 80 | 60 | 100 | 80 | 100 |
| $K_2C_4H_4O_6$ | 80 | — | — | — | — | — | — |
| $K_3C_6H_5O_7$ | — | 100 | 70 | 20 | 70 | — | 100 |
| $K_2HPO_4$ | — | — | 30 | 80 | | 90 | — |
| $K_4P_2O_7$ | — | — | — | — | 30 | — | — |
| $H_3BO_3$ | 20 | 20 | — | — | 20 | — | — |
| KSeCN | 0.0005 | 0.001 | 0.001 | 0.0005 | 0.0001 | — | 0.0005 |
| $C_{20}H_{26}N_4O_6S_2$ | 0.1 | — | — | — | — | — | — |
| $C_{21}H_{14}N_3NaO_3S_3$ | — | 0.001 | — | — | 0.01 | — | — |
| $C_{26}H_{32}N_3NaO_6S_2$ | — | — | 0.01 | — | — | — | — |
| $C_{28}H_{19}N_5Na_2O_6S_4$ | — | — | — | 0.1 | — | — | — |
| $C_{12}H_{25}(CH_2CH_2O)_{23}H$ | 0.01 | — | 0.01 | — | — | — | |
| $H(OCH_2CH_2)_nOH$ | — | 0.1 | — | 1 | 0.1 | | 0.1 |

Note that the names of the compounds of Table 1 are shown in Table 2.

TABLE 2

| Chemical structure | Chemical name |
|---|---|
| $KAg(CN)_2$ | Silver potassium cyanide |
| $K_2C_4H_4O_6$ | Potassium tartarate |
| $K_3C_6H_5O_7$ | Tripotassium citrate |
| $K_2HPO_4$ | Dipotassium hydrogenphosphate |
| $K_4P_2O_7$ | Potassium pyrophosphate |
| $H_3BO_3$ | Boric acid |
| KSeCN | Potassium selenocyanate |
| $C_{20}H_{26}N_4O_6S_2$ | Basic Blue 41 (Compound 1-i) |
| $C_{21}H_{14}N_3NaO_3S_3$ | Primulin (Compound 1-d) |
| $C_{26}H_{32}N_3NaO_6S_2$ | Melocyanine 540 (Compound 1-c) |
| $C_{28}H_{19}N_5Na_2O_6S_4$ | Mimosa (Compound 1-c) |
| $C_{12}H_{25}(CH_2CH_2O)_{23}H$ | Polyoxyethylene lauryl ether |
| $H(OCH_2CH_2)_nOH$ | Polyethylene glycol |

Table 3 shows the current density range, gloss degree, etc.

TABLE 3

| | Good current density range/A/dm$^2$ | Brightness degree | Unevenness | Protrusions of silver | Die bondability | Die shareability | Heat resistance |
|---|---|---|---|---|---|---|---|
| Ex. 1 | 50 to 200 | 0.3 to 0.4 | None | None | Good | Good | Good |
| Ex. 2 | 50 to 200 | 0.3 to 0.4 | None | None | Good | Good | Good |
| Ex. 3 | 50 to 200 | 0.3 to 0.4 | None | None | Good | Good | Good |
| Ex. 4 | 50 to 150 | 0.3 to 0.4 | None | None | Good | Good | Good |
| Ex. 5 | 50 to 300 | 0.3 to 0.4 | None | None | Good | Good | Good |
| Comp. Ex. 1 | 50 to 90 | 0.1 to 0.3 | None | None | Good | Good | Good |
| Comp. Ex. 2 | 50 to 300 | 0.4 to 1.2 | None | None | Good | Good | Good |

Examples 1 to 3 show plating solutions using gloss adjusters having benzothiazole skeletons, while Examples 4 and 5 show ones changed in silver concentration. Comparative Example 1 shows a solution of a simple composition of just a silver salt and conductive salt, while Comparative Example 2 shows a solution like in the past including a brightener and surfactant.

The plating solutions of these compositions were used to conduct Hull cell tests and the gloss adjustment effects were evaluated from the Hull cell patterns.

Further, 3 cm×3 cm copper test pieces were silver plated to 1 cmϕ and 5 μm by jet plating and compared for current densities giving good semi-bright appearances.

EXAMPLES 1 to 3

The pH of the solutions were stable at 8 to 9. The Hull cell patterns had semi-bright appearances over broad ranges. The platings were good in appearance with even brightness degree and no unevenness. The plating films prepared by jet plating tests had semi-bright appearances with brightness degrees of 0.4±0.05 or no substantial variation in the current density range of 50 to 200 A/dm$^2$. Further, the crystals of the silver film having matt or a semi-bright were dense and the mounting properties were sufficiently satisfactory.

Further, similar results were obtained when conducting similar experiments for Direct Yellow 8, Thioflavin S, and Thioflavin T for the brightness adjuster.

Note that the brightness degree was measured using a Densitometer ND-1 made by Nippon Denshoku. Incidentally, a brightness degree of not more than 0.2 is defined as a matt plating and a brightness degree of up to 0.8 as semi-bright plating.

EXAMPLE 4

This composition has a lower silver concentration compared with Examples 1 to 3. The semi-bright region of the Hull cell pattern had a semi-bright appearance of an even dull appearance. In a jet plating test, no burnt deposits occurred up to a high current density range of over 100 A/dm$^2$. The obtained plating film had an even semi-bright appearance.

EXAMPLE 5

This composition has an increased silver concentration compared with Examples 1 to 3. The semi-bright region of the Hull cell pattern was broad and an even, good film was obtained. Further, in a jet plating test, a silver film having a semi-bright appearance was obtained up to a range of current density of 300 A/dm$^2$. The film was of uniform quality with no blistering or unevenness.

COMPARATIVE EXAMPLE 1

This composition contains no additives at all. The Hull cell pattern was white overall and the appearance was a white one close to a burn. In a jet plating test, burnt deposits ended up occurring with a current density of over 100 A/dm$^2$. The current density giving a semi-bright appearance was a narrow range of 50 to 90 A/dm$^2$.

COMPARATIVE EXAMPLE 2

This composition contains a brightener and surfactant as in the past. The brightness degree of the semi-bright region of the Hull cell pattern was a somewhat shiny brightness. Further, a sample prepared by a jet plating test was free of burnt deposits up to a range of current density of 200 A/dm$^2$ and was satisfactory in mounting properties, but the appearance became an appearance with somewhat of a brightness degree of about 0.8 to 1.0.

INDUSTRIAL APPLICABILITY

As explained above, the silver electroplating solution of the present invention using a cyanide as a silver source and containing a brightness adjuster can give good matt to semi-bright silver plating film with little variation in brightness degree in a broad current density range and free of unevenness or burn with a high current density. Therefore, ring plating of difficult-to-plate SO type lead frames or QFP lead frames and high speed, stable plating of complicatedly shaped lead frames and other plated objects become possible. Further, the brightness degree of the silver plating films obtained from these baths can be controlled in brightness effect of the brightener by adding a gloss adjuster and the brightness degree of the silver plating film can be freely adjusted. Further, by raising the concentration of the brightness adjuster, the effect of suppression of brightness becomes greater, so increasing the concentration of the brightener becomes possible, control of the concentration by analysis becomes possible, and a high working current density is obtained, so the production efficiency is improved.

The invention claimed is:

1. A silver electroplating solution comprising:

a cyanide as a silver source;

at least one compound of As (arsenic), Tl (thallium), Se (selenium), or Te (tellurium) as a brightener; and a brightness adjuster for suppression of brightness having a benzothiazole skeleton, wherein the brightness adjuster for suppression of brightness has the formula

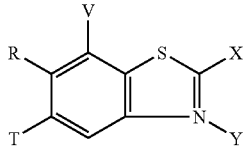

wherein

R is H, $CH_3$, or $CH_3O$,

T is H,

V is H or $SO_3Na$,

Y is H or $CH_3$,

X is one of the following a to i a.

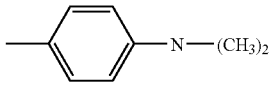

b.

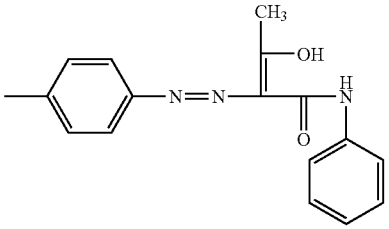

c.

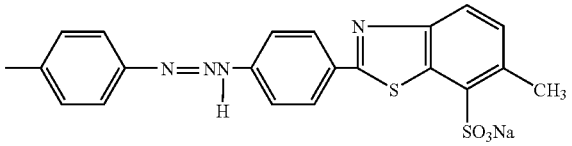

d.

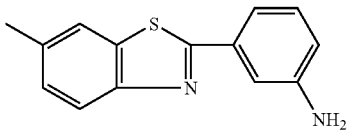

e.

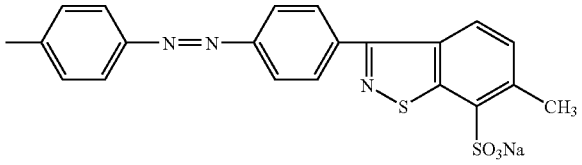

f.

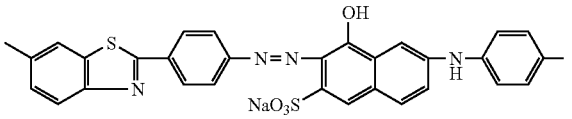

g.

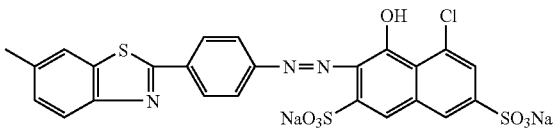

-continued h.

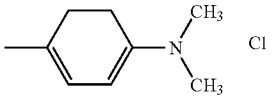

Cl encounter ion i.

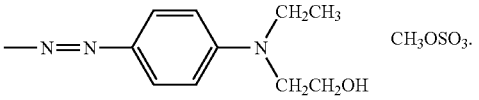

$CH_3OSO_3$ encounter ion

2. A silver electroplating solution as set forth in claim 1, wherein said brightener is in an amount of 0.005 to 50 mg/liter.

3. A silver electroplating solution as set forth in claim 1, wherein said brightness adjuster for suppression of brightness is in an amount of 1 to 1000 mg/liter.

4. A silver electroplating solution as set forth in claim 1, wherein said brightener is in an amount of 0.01 to 5 mg/liter.

5. A silver electroplating solution as set forth in claim 1, further comprising a nonionic surfactant having a polyoxyethylene chain or a fluorine-based surfactant in an amount of 0.001 to 10 g/liter.

6. A silver electroplating solution as set forth in claim 1, further comprising 50 to 300 g/liter of a silver alkali metal cyanide as the silver source and 50 to 300 g/liter of at least one of a citrate, phosphate, tartarate, or succinate as a conductive salt.

7. A silver electroplating solution comprising:

a cyanide as a silver source;

at least one compound of As (arsenic), Tl (thallium), Se (selenium), or Te (tellurium) as a brightener; and a brightness adjuster for suppression of brightness having a benzoxazole skeleton, wherein the brightness adjuster for suppression of brightness has the formula

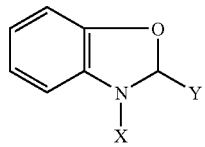

wherein

X is —$CH_2CH_2CH_2CH_2SO_3Na$,

Y is one of the following a to b a.

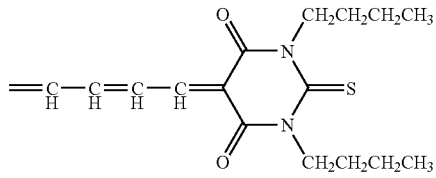

b.

-continued

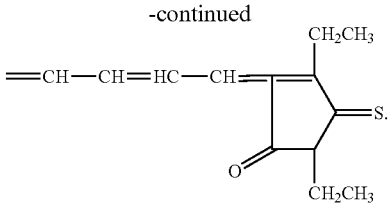

8. A silver electroplating solution as set forth in claim 7, wherein said brightener is in an amount of 0.005 to 50 mg/liter.

9. A silver electroplating solution as set forth in claim 7, wherein said brightness adjuster for suppression of brightness is in an amount of 1 to 1000 mg/liter.

10. A silver electroplating solution as set forth in claim 7, wherein said brightener is in an amount of 0.01 to 5 mg/liter.

11. A silver electroplating solution as set forth in claim 7, further comprising a nonionic surfactant having a polyoxyethylene chain or a fluorine-based surfactant in an amount of 0.001 to 10 g/liter.

12. A silver electroplating solution as set forth in claim 7, further comprising 50 to 300 g/liter of a silver alkali metal cyanide as the silver source and 50 to 300 g/liter of at least one of a citrate, phosphate, tartarate, or succinate as a conductive salt.

13. A silver electroplating solution comprising:

a cyanide as a silver source;

at least one compound of As (arsenic), Tl (thallium), Se (selenium), or Te (tellurium) as a brightener; and a brightness adjuster for keeping down a brightness degree having the formula

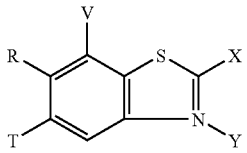

wherein

R is H, $CH_3$, or $CH_3O$,

T is H,

V is H or $SO_3Na$,

Y is H or $CH_3$,

X is one of the following a to i a.

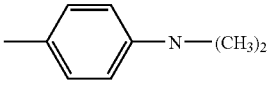

b.

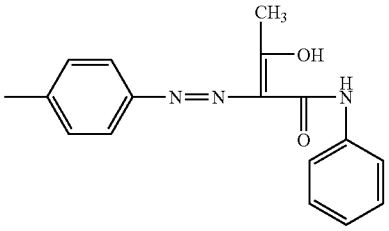

c.

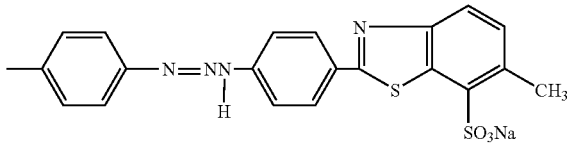

d.

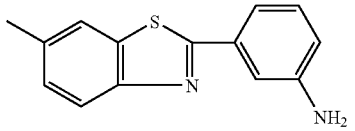

e.

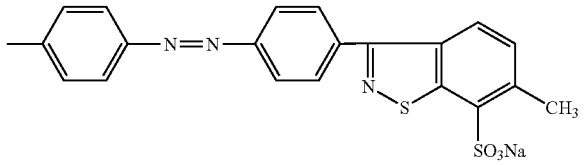

f.

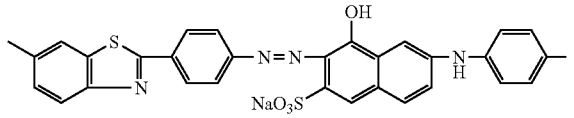

g.

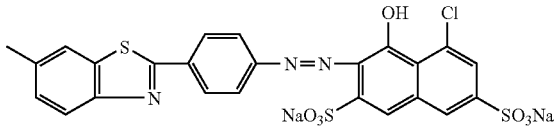

h.

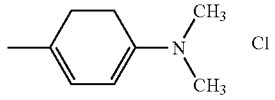

Cl encounter ion i.

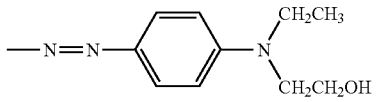

$CH_3OSO_3$ encounter ion

14. A silver electroplating solution comprising:

a cyanide as a silver source;

at least one compound of As (arsenic), Tl (thallium), Se (selenium), or Te (tellurium) as a brightener; and a brightness adjuster for keeping down a brightness degree having the formula

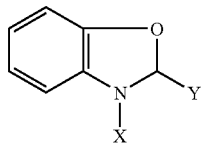

wherein
X is —$CH_2CH_2CH_2SO_3Na$,
Y is one of the following a to b
a.
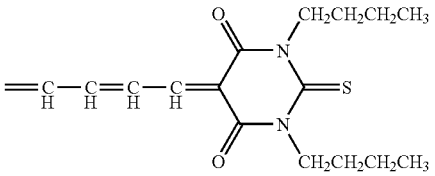
b.
-continued
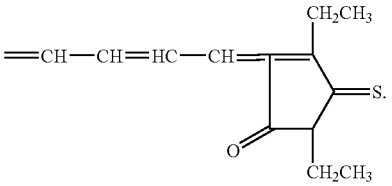
* * * * *